US005863097A

United States Patent [19]

Harper et al.

[11] Patent Number: 5,863,097

[45] **Date of Patent: *Jan. 26, 1999**

[54] INFANT BOUNCER

[75] Inventors: Marjorie G. Harper, Littleton; Patrick M. Bertsch, Thornton, both of Colo.

[73] Assignee: Evenflo Company, Inc., Tampa, Fla.

[ * ] Notice: Under 35 U.S.C. 154(b), the term of this patent shall be extended for 626 days.

[21] Appl. No.: 492,241

[22] Filed: Jun. 19, 1995

Related U.S. Application Data

[63] Continuation of Ser. No. 942,423, Sep. 9, 1992, Pat. No. 5,575,530.

[51] Int. Cl.[6] ..... A47C 3/02

[52] U.S. Cl. ..... 297/260.2; 297/183.2; 297/270.1

[58] Field of Search ..... 5/108, 109; 297/260.1, 297/260.2, 326, 183.2, 183.6, 270.1

[56] References Cited

U.S. PATENT DOCUMENTS

| | | | |
|---|---|---|---|
| 1,524,416 | 1/1925 | Waitekaites et al. | 5/109 |
| 1,586,411 | 5/1926 | Csima | 5/109 |
| 1,836,353 | 12/1931 | Withrow | 297/326 X |
| 3,019,052 | 1/1962 | Zawadzki | 297/260.2 |
| 3,319,271 | 5/1967 | Austin | 5/109 |
| 3,653,080 | 4/1972 | Hafele | 297/260.2 X |
| 4,141,095 | 2/1979 | Adachi | 5/108 |
| 4,634,177 | 1/1987 | Meeker | 297/250 |
| 4,656,680 | 4/1987 | Wilson | 5/108 |
| 4,982,997 | 1/1991 | Knoedler et al. | 297/296 |
| 4,986,599 | 1/1991 | Wise | 297/183 |
| 5,342,113 | 8/1994 | Wu | 297/260.2 |

*Primary Examiner*—Jerry Redman
*Attorney, Agent, or Firm*—Robert G. Crouch; Holland & Hart LLP

[57] ABSTRACT

The present invention provides an infant carrier having a bouncer mode of operation in which the bouncer mechanism is designed such that a harmonic vibration will be established regardless of varying weights of infants placed within the carrier. In addition, the infant carrier includes a mechanism for locking a carrying handle in one of two positions including cooperating camming surfaces formed on detent members of the handle and recess portions of the sides of the infant carrier.

20 Claims, 5 Drawing Sheets

INFANT BOUNCER

This is a continuation of application Ser. No. 07/942,423, filed Sep. 9, 1992 now U.S. Pat. No. 5,575,530.

BACKGROUND OF THE INVENTION

The present invention relates to an infant carrier and, more particularly, to an infant carrier having a bouncer feature to provide a soothing oscillating movement to an infant in the carrier.

Infant carriers are well known and many different configurations for infant carriers have been proposed in the prior art. Prior art infant carriers commonly include a shell for receiving an infant and a movable handle or handles for carrying the carrier with the infant therein. In addition, U.S. Pat. No. 4,982,997 to Knoedler et al discloses an infant carrier having a bouncer feature wherein, in one mode of operation, the shell portion for the carrier is suspended above a base portion by means of flexible spring rods which provide for a bouncing motion of the carrier shell relative to the base portion.

Another important feature for infant carriers is the provision of a handle which may be located at a plurality of positions including a storage position where the handle is located adjacent to the carrier shell and a carrying position where the handle is located above the cavity for receiving the infant. Various mechanisms have been proposed for locating infant carrier handles in their desired positions. However, such mechanisms are typically complex and require an inordinate number of parts to effect their operation.

Accordingly, there is a need for an infant carrier having a simple design and which provides for a bouncing mode of operation. In addition, there is a need for an infant carrier including a handle which is movable to different positions and which includes a simple mechanism for locking the handle at predetermined orientations relative to the carrier shell.

SUMMARY OF THE INVENTION

The present invention provides an infant carrier which in one aspect comprises: a shell for receiving an infant; a base portion for supporting the shell on a support surface; spring means connecting a first portion of the shell to the base portion; and pivot means connecting a second portion of the shell to the base portion.

The invention is further characterized by the pivot means including a resilient bushing for supporting the shell for pivotal movement about a front end of the shell. The spring means is located adjacent to a rear end of the shell and includes a compression spring having a spring rate which increases with increasing compression.

In another aspect of the invention, an infant carrier is provided comprising: a shell including first and second opposing side walls defining a cavity for receiving an infant; a base portion; spring means connecting the shell to the base portion; a handle including first and second leg portions connected by a lateral portion; pivot means attaching the first and second leg portions to the first and second side walls whereby the handle is mounted for pivotal movement about a pivot axis relative to the shell; and positioning means including cooperating surfaces on the handle and the side walls for defining a plurality of predetermined positions for the handle.

The handle is further characterized by means defining angled cooperating recess and detent camming surfaces such that application of a rotational force to the handle about the pivot axis causes the detent surface to move in sliding engagement along the recess surface from a first to a second rotational position.

It is therefore an object of the invention to provide an infant carrier which has a bouncer mode of operation.

It is another object of the invention to provide an infant carrier having spring means and pivot means at opposing ends of the carrier.

It is a further object of the invention to provide an infant carrier having a pivotable handle wherein a simple mechanism is provided for locating the handle in different positions.

Other objects and advantages of the invention will be apparent from the following description, the accompanying drawings, and the appended claims.

DETAILED DESCRIPTION OF THE PREFERRED EMBODIMENT

Figure 1:
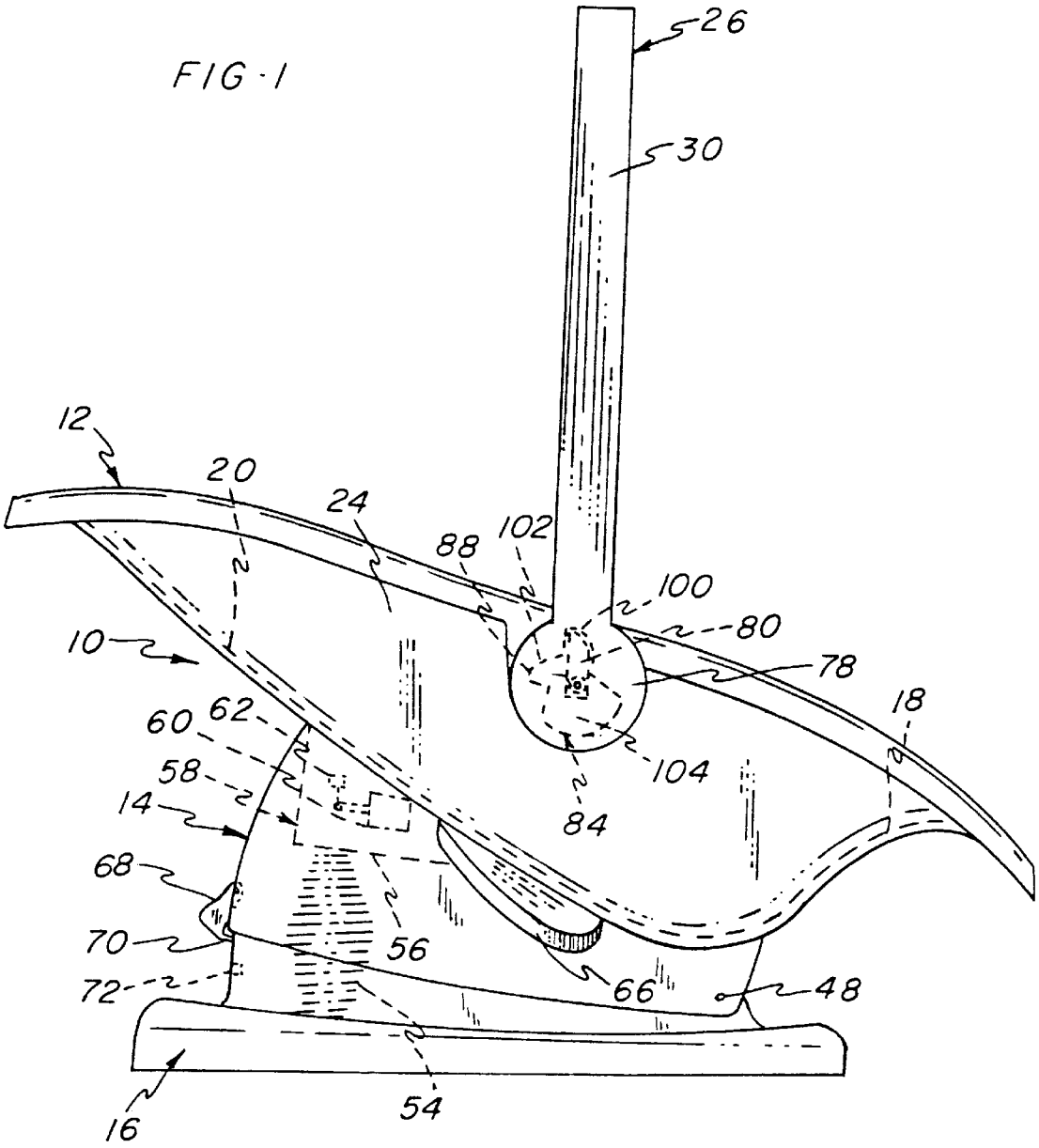
FIG. 1 is a side elevational view of the infant carrier of the present invention.
Figure 2:
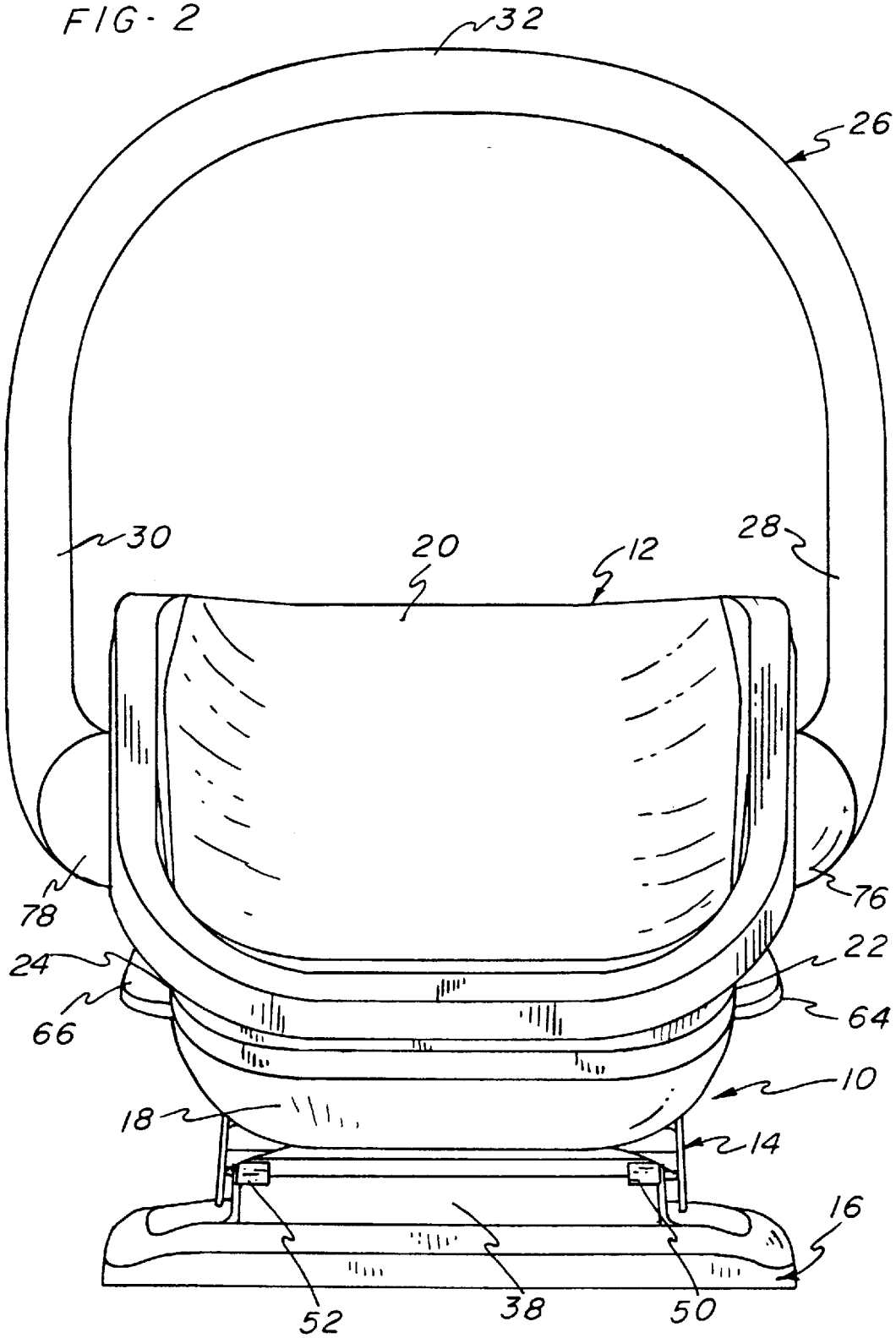
FIG. 2 is a front elevational view of the infant carrier.

Referring to FIGS. 1 and 2, the infant carrier of the present invention includes a shell assembly 10 which comprises a shell 12 and a lower shroud 14. The infant carrier further includes a base 16 for supporting the shell assembly 10.

The shell 12 of the shell assembly 10 is defined by a seat portion 18, a back portion 20, and laterally opposed first and second side portions 22, 24 extending along the seat and back portions 18 and 20. In addition, a handle 26 including first and second leg portions 28, 30 and a lateral portion 32 connecting the leg portions 28, 30 is attached to the sides 22, 24 for pivotal movement, as will be described further below.

Figure 3:
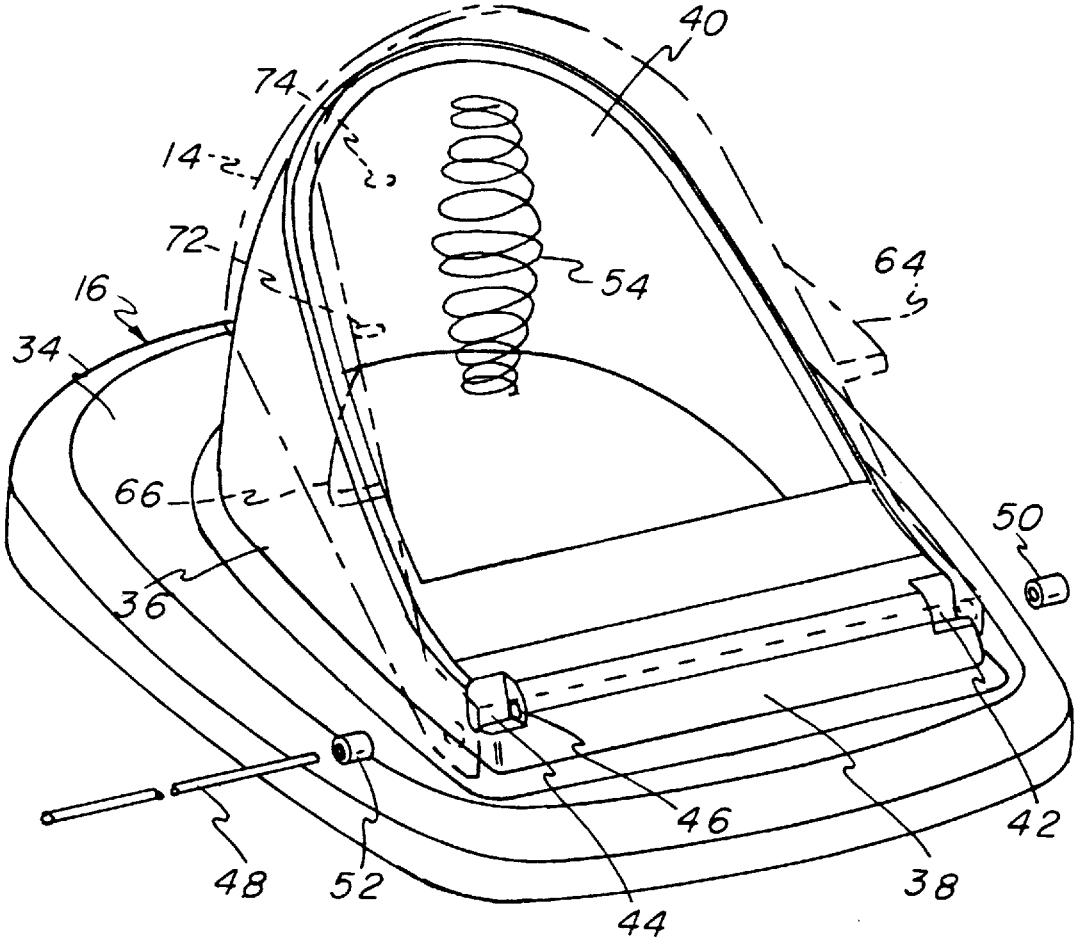
FIG. 3 is a partially exploded perspective view showing the structure of the base and illustrating the attachment of the lower shroud thereto.

Referring to FIG. 3, the base 16 includes a wide peripheral foot portion 34 for supporting an upwardly extending support pedestal 36 which includes a front shell support portion 38 and a rear peripheral wall 40.

The front shell support portion includes means defining laterally opposed first and second shelf portions 42, 44 and opposed apertures 46 located adjacent to the shelf portions 42, 44.

Figure 4:
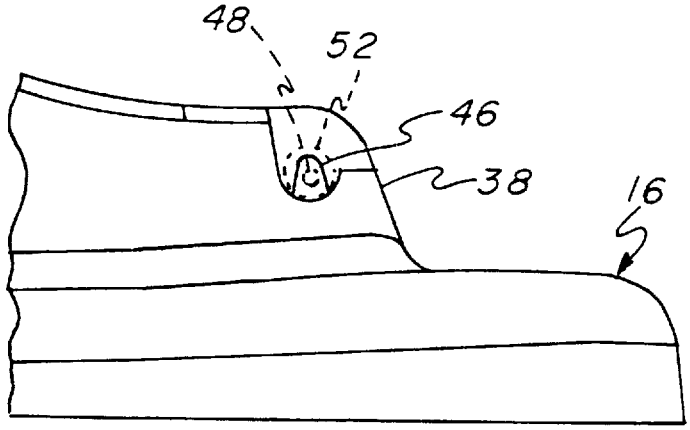
FIG. 4 is a detail view of the front pivot point between the shell assembly and the base.

The shroud 14 of the shell assembly 10 is formed as a peripheral wall configured to extend around the rear wall 40 and front support portion 38 of the base 16. The shroud 14 includes a pair of laterally opposed apertures in a front portion thereof for alignment with the opposed apertures 46 of the base 16. A pivot axle 48 extends through the base apertures 46 and the apertures in the front of the shroud 14 whereby the shell assembly 10 is mounted for pivotal movement relative to the base 16. In addition, as may be seen in FIG. 4, the base apertures 46 are formed having an elongated shape in a vertical direction and being wider at the bottom than at the top thereof such that the axle 48 may undergo a limited amount of jiggling motion relative to the base 16. Further, a pair of resilient rubber bushings are supported on the pivot axle 48 and rest within respective shelf portions 42, 44 of the base 16. Thus, during jiggling motion of the shell assembly 10 and the pivot axle 48 with respect to the base 16, the bushings 50, 52 provide a cushion to resiliently support the shell assembly 10 and thereby enhance and cushion bouncing movement of the assembly 10, as will be described more fully below.

As may be seen in FIG. 3, a spring 54 is supported on the base portion 16 at a lower end thereof and an upper portion of the spring 54 engages a lower wall 56 of a housing 58 on the shroud 14 for mounting a vibrating mechanism (see also FIG. 1). The spring 54 is preferably a barrel spring which exhibits an increasing spring rate as the spring 54 is compressed. The spring 54 controls pivotal movement of the shell assembly 10 about a pivot axis defined by the pivot axle 48. By providing a spring having an increasing spring rate with increasing compression, the vibrational characteristics of the shell assembly 10 relative to the base 16 will remain substantially constant regardless of the weight of the infant placed within the shell 12. In order to induce a vibration into the shell assembly 10 to maintain a constant harmonic vibration, the motor housing 58 is located within the shroud 14 and is shown generally diagrammatically as including a motor 60 for driving a weighted member 62 in a circular path such that a force is cyclically applied to the shell assembly 10. It should be noted that the mechanism for inducing vibration in the shell assembly is conventional and may include any well known design for creating the desired cyclic force on the shell assembly. It should further be noted that the motor housing 58 may be mounted at other locations in the shell assembly 10 such as on the outside of the shroud 14, in which case the spring will extend up into contact with the back 20 of the shell 12.

The speed of the motor 60 is selected such that a harmonic oscillation will be set up in combination with the resilient force applied by the spring 54. Further, as a result of selecting a spring having an increasing spring rate, the particular weight of an infant placed within the cavity of the shell 12 will not affect the relationship between the motor speed and the spring rate applied by the spring 54 against the shell assembly 10 such that the shell assembly 10 will undergo a harmonic vibrational movement regardless of the weight of the infant without the need for altering the speed of the motor and the cyclic force applied by the weight 62.

In addition, the loose cushioned connection at the pivot axle 48 facilitates the vibrational movement created by the motor 60 and weight 62 and the spring 54 by providing for limited horizontal and vertical components of movement. It should also be noted that the resilient bushings 50, 52 prevent the axle 48 from impacting against the sides of the apertures 46 to ensure quiet operation of the infant carrier during its bouncer mode of operation.

In order to permit the infant carrier to be used in the bouncer mode without operation of the motor 60, the shell assembly 10 is further provided with a pair of foot pedals 64, 66 mounted to the shroud 14 and extending laterally outwardly beyond the side walls 22 and 24. Thus, vibration of the shell assembly 10 may be conveniently induced by a person pressing on one of the pedals 64, 66 with his or her foot.

Figure 5:
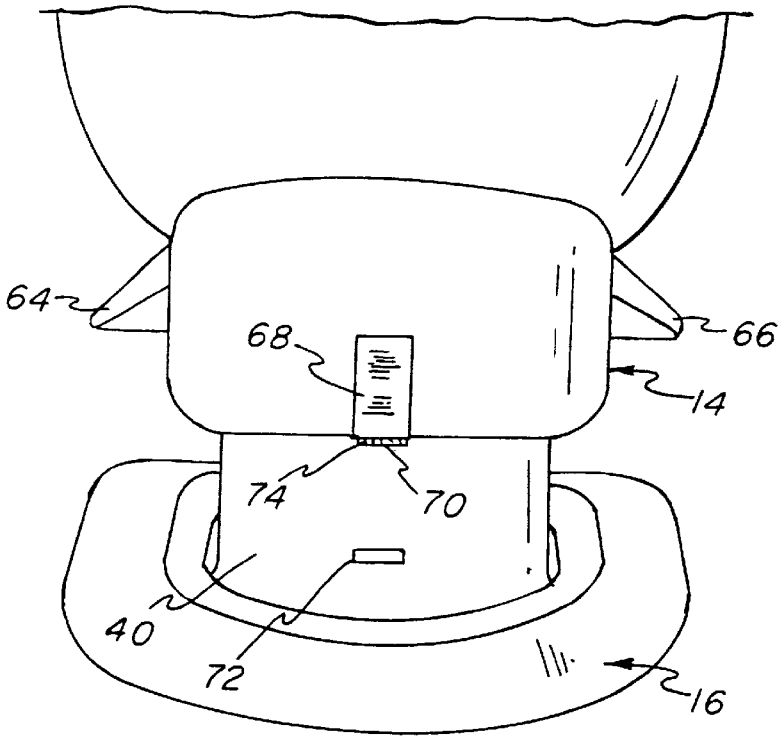
Fig. 5 is a rear view of the carrier adjacent to the base.

Referring to FIGS. 1 and 5, a locking mechanism in the form of a locking block 68 is pivotally mounted adjacent to a lower rear edge of the shroud 14 and includes a tang portion 70. The rear wall 40 of the base 16 includes means defining a lower slot 72 and an upper slot 74 for receiving the tang 70 of the locking block 68. In a carrier or rest mode of operation for the infant carrier, the shell assembly 10 may be pushed downwardly to compress the spring 54 and engage the tang 70 with the lower slot 72 whereby the infant may be placed in a reclining rest position and the infant carrier is placed in a compact configuration such that it may be conveniently carried by the handle 26.

In a feeding mode of operation for the infant carrier, the tang 70 may be engaged in the upper slot 74 such that the back portion 20 is oriented at a more steeply inclined angle to define a stationary position for the shell assembly and which holds the infant in a position which is convenient for feeding.

An additional unique aspect of the present invention resides in the mechanism for locating the handle in two predetermined positions with respect to the shell 12, and each of the legs 28, 30 of the handle 26 is provided with a substantially circular end portion 76 and 78 including the locking mechanism. It should be understood that the locking mechanism for the handle 26 is substantially identical for each of the end portions 76, 78, and the mechanism will therefore be described with reference to the end portion 78 and the cooperating structure on the side 24 of the shell 12.

Figure 6A:
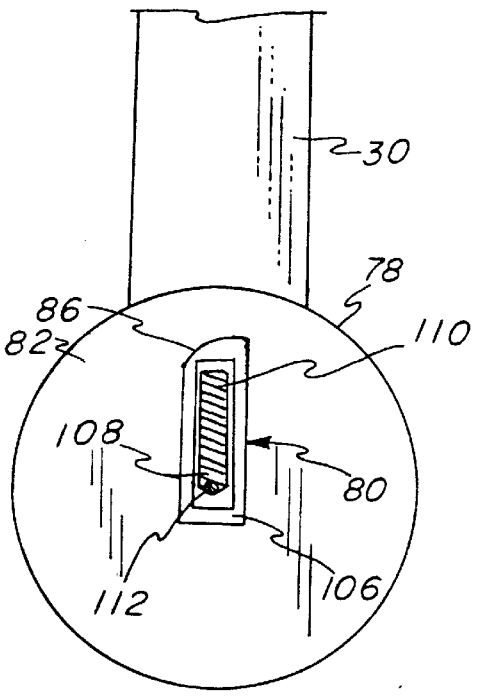
FIG. 6A is a side elevational view showing the detent portion of the handle actuation mechanism.
Figure 6B:
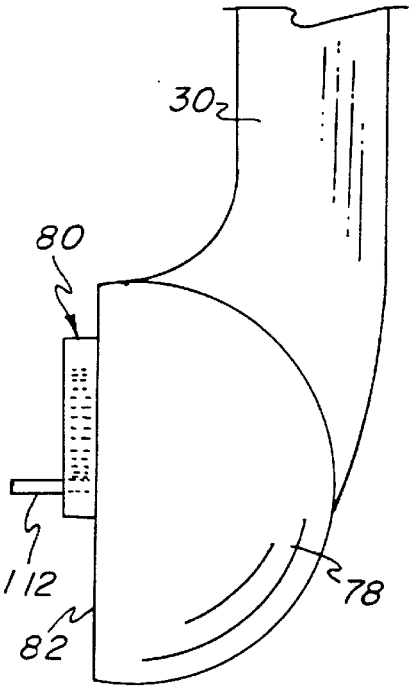
FIG. 6B is a front elevational view showing the detent portion of the handle actuation mechanism.

Referring to FIGS. 1, 6A and 6B, the mechanism for locking the handle 26 in position generally includes a detent member 80 protruding from an inside surface 82 of the end portion 78, and a recess portion 84 defined in the side 24 of the shell 12. The detent member 80 is formed as a generally rectangular element having an angled camming surface 86 formed at an upper corner thereof.

The recess portion 84 includes a first recess area 88 and a second recess area 100 wherein the recess areas 88, 100 each define a width which is substantially equal to or slightly greater than the width of the detent 80, and the recess area 88 includes an angled camming surface 102 for engaging the angled camming surface 86 of the detent 80. A third larger recess area 104 is provided below the first and second recess areas 88, 100 for receiving a lower portion 106 of the detent 80.

As may be seen in FIG. 6A, the detent 80 includes a slot 108 having a compression spring 110 therein. An upper end of the spring 110 abuts an upper wall of the slot 108 and a lower end of the spring abuts a pivot pin 112 which extends from a location within the slot 108 and through an aperture formed within the recess portion 84 of the side 24. Thus, the end portion 78 is mounted for movement along the length of the detent 80 in a direction perpendicular to the longitudinal axis of the pin 112, as well as for pivotal movement about the pin 112.

Figure 7:
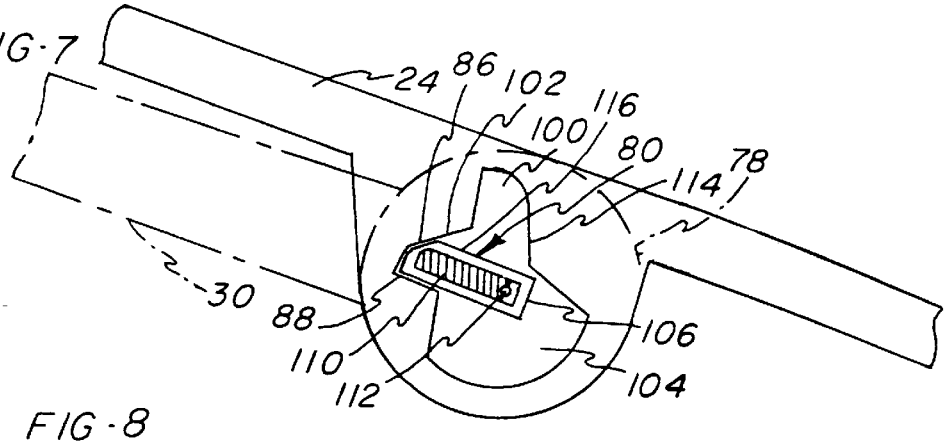
FIGS. 7–9 are diagrammatic views of the movement of the handle actuation mechanism relative to cooperating surfaces on the sides of the shell assembly.
Figure 8:
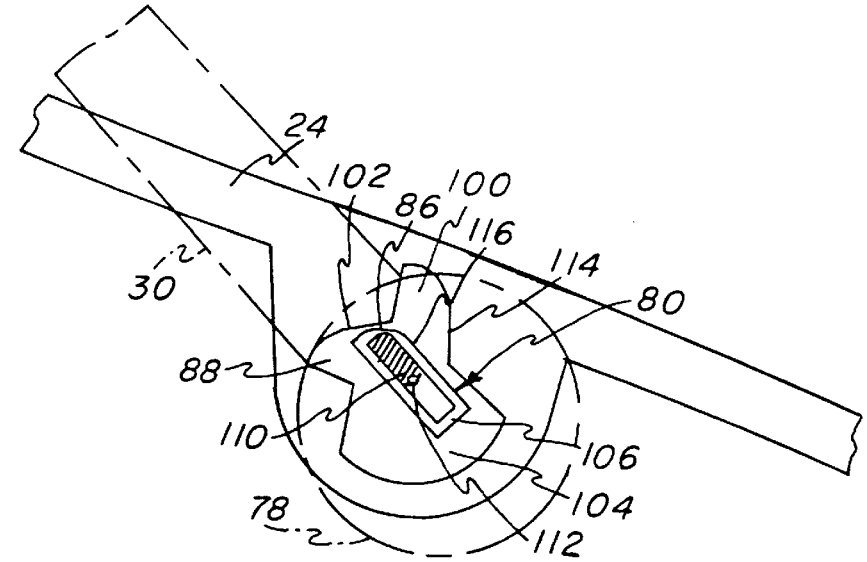
Figure 9:
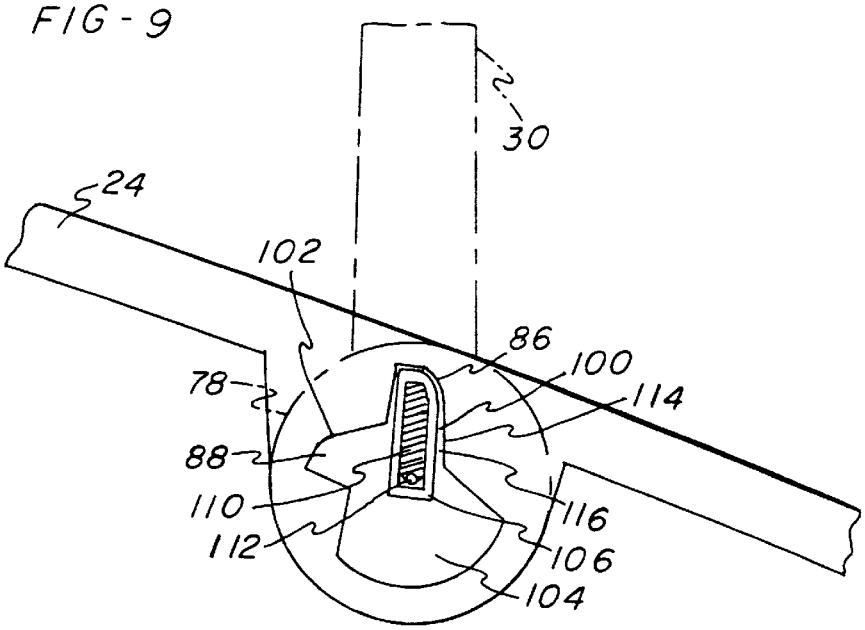

Referring to FIGS. 7–9, the detent 80 is shown in FIG. 7 positioned in the first recess area 88 to locate the handle 26 in a first position with the lateral portion 32 located closely adjacent to an upper rear edge of the shell 12. It should be apparent that the spring 110 acts between the detent 80 and the pin 112 such that the detent moves firmly into engagement within the recess area 88. The handle 26 may be located within the first position when the infant carrier is used in any of its non-carrying modes of operation such as in the bouncer or feeding mode of operation.

When it is desired to move the handle 26 from its first position to a second position where the lateral portion 32 is located directly above the cavity of the shell 12, a force may be applied to the lateral portion 32 in the direction of the pivot axis defined by the pin 112 such that the spring 110 is compressed and the handle may be pivoted upwardly until the detent 80 is engaged within the second recess area 100, as illustrated in FIG. 9.

Alternatively, if a person should find it inconvenient or forget to push inwardly on the handle 26 while pulling it upwardly and only apply a rotational force to the handle 26, the detent and recess camming surfaces 86 and 102 will cooperate with each other to guide the detent 80 down into the third recess area 104 such that the spring 110 is compressed as the detent 80 is rotated toward the second recess 100, as depicted at FIG. 8. It should be noted that the side wall 114 of the second recess area 100 adjacent to the third recess area 104 is substantially parallel to the side 116 of the detent 80 adjacent to the camming surface 86 such that further rotational movement of the handle 26 past the second recess area 100 is prevented.

In the second position of the handle 26, the handle 26 may be used to carry the infant carrier in a conventional manner and in this application, it is preferable that the locking block 68 be engaged within the lower slot 72 of the base 16 to prevent movement of the base 16 relative to the shell assembly 10.

Finally, when it is desirable to move the handle 26 back to its first position, it is necessary to push downwardly on the handle 26 such that the lower portion 106 of the detent 80 moves down into the third recess area 104 until the detent 80 is clear of the second recess area 100 and may be pivoted back downwardly into the first recess area 88. It should be apparent that the third recess area 104 provides the clearance area required for the lower portion 106 of the detent to move downwardly during compression of the spring 110 for movement between the first and second positions.

From the above description, it should be apparent that the present invention provides an infant carrier having a bouncer mode of operation wherein a harmonic bouncing frequency will be established regardless of varying weights of infants placed in the carrier. In addition, it should be apparent that the present infant carrier provides a unique and simple mechanism for permitting the handle to be locked in one of two operable positions.

While the form of apparatus herein described constitutes a preferred embodiment of the invention, it is to be understood that the invention is not limited to this precise form of apparatus, and that changes may be made therein without departing from the scope of the invention, which is defined in the appended claims.

What is claimed is:

1. A bouncer for supporting an infant in bouncing motion comprising:

a base member for supporting said bouncer on a horizontal surface;

an infant support member for receiving an infant, said infant support member supported on said base member;

a resilient member defining a resilient connection between said base member and said infant support member;

a vibrating mechanism connected to said infant support member for transmitting a vibration to said infant support member; and wherein said vibrating mechanism comprises a motor mounted on said infant support member for movement with said infant support member relative to said base member.

2. The bouncer as recited in claim 1 wherein said vibrating member comprises a housing surrounding said motor and supported for vibratory movement with said infant support member.

3. The bouncer as recited in claim 2 wherein said housing encloses a mechanism for producing a cyclical vibratory force to move said infant support member in vibratory movement relative to said base member.

4. The bouncer as recited in claim 3 wherein said mechanism includes a weighted member comprising a swinging weight driven in movement by said motor.

5. The bouncer as recited in claim 4 wherein said swinging weight is driven in circular movement.

6. The bouncer as recited in claim 1 wherein said vibrating mechanism comprises a weighted member including a swinging weight driven in movement by said motor, said swinging weight being cyclically movable to produce a vibratory force.

7. The bouncer as recited in claim 6 wherein said vibrating mechanism is mounted adjacent to an end of said resilient member.

8. The bouncer as recited in claim 7 wherein said resilient member comprises a spring supporting said infant support member.

9. The bouncer as recited in claim 8 wherein said spring comprises a compression spring.

10. The bouncer as recited in claim 1 wherein said vibrating mechanism is mounted at an end of said infant support member and an opposite end of said infant support member is connected to said base member.

11. A bouncer for supporting an infant in bouncing motion comprising:

a base portion for supporting said bouncer on a horizontal surface;

an infant support portion for supporting an infant;

a spring portion extending between said base portion and said infant support portion, said spring portion resiliently supporting said infant support portion for movement relative to said base portion; and a vibrating mechanism including a motor supported on said infant support portion for movement with said infant support portion relative to said base portion, and said vibrating mechanism including a weighted member driven by said motor and movable to produce a force on said infant support portion whereby said infant support portion is caused to vibrate on said spring portion.

12. The bouncer as recited in claim 11 wherein said weighted member comprises a swinging weight and said motor causes said swinging weight to move in a circular path.

13. The bouncer as recited in claim 11 wherein said motor and said weighted member are contained within a housing mounted to said infant support portion.

14. The bouncer as recited in claim 11 wherein said infant support portion includes an end pivotally attached to said base portion at a pivot point.

15. The bouncer as recited in claim 14 wherein said spring portion is supported on said base in spaced relation to said pivot point.

16. The bouncer as recited in claim 15 wherein said spring portion comprises a coil spring.

17. The bouncer as recited in claim 11 wherein said weighted member is supported with said motor and is free of connections to said base portion.

18. The bouncer as recited in claim 11 wherein movement of said weighted member produces a harmonic vibratory movement of said infant support portion.

19. A bouncer for supporting an infant in bouncing motion comprising:

a base member for supporting said bouncer on a horizontal surface;

an infant support member including an infant receiving area for receiving an infant in a reclining position, said infant support member supported on said base member;

a resilient spring connection between said infant support member and said base member, said resilient spring connection resiliently supporting said infant support member for movement relative to said base member; and a vibrating mechanism including a motor and a swinging weight supported for rotating cyclical movement on an end of said motor, said motor supported on said infant support member for movement with said infant support member relative to said base member wherein said swinging weight is free of connections to said base member, and said swinging weight produces a harmonic vibratory movement of said infant support member during the cyclical rotating movement of said swinging weight.

20. An apparatus for supporting an infant comprising:

a base portion for supporting said apparatus on a horizontal surface;

an infant support portion including an infant receiving area for receiving an infant in a reclining position, said infant support portion supported on said base portion; and a vibrating mechanism including a motor and a swinging weight supported for rotating cyclical movement on an end of said motor, said motor supported on said infant support portion for movement with said infant support portion wherein said swinging weight is free of connections to said base portion such that said swinging weight produces a vibratory movement of said infant support portion.

* * * * *